US006743308B2

(12) United States Patent
Tanaka et al.

(10) Patent No.: US 6,743,308 B2
(45) Date of Patent: Jun. 1, 2004

(54) ALUMINUM ALLOY STRUCTURAL PLATE EXCELLING IN STRENGTH AND CORROSION RESISTANCE AND METHOD OF MANUFACTURING SAME

(75) Inventors: Hiroki Tanaka, Osaka (JP); Hiroki Esaki, Gifu (JP); Tadashi Minoda, Nagoya (JP)

(73) Assignees: Kabushiki Kaisha Kobe Seiko Sho., Kobe (JP); Sumitomo Light Metal Industries, Ltd., Tokyo (JP); Nippon Light Metal Co., Ltd., Tokyo (JP); The Furukawa Electric Co., Ltd., Tokyo (JP); Mitsubishi Aluminum Co., Ltd., Tokyo (JP)

( * ) Notice: Subject to any disclaimer, the term of this patent is extended or adjusted under 35 U.S.C. 154(b) by 101 days.

(21) Appl. No.: 10/003,515

(22) Filed: Nov. 2, 2001

(65) Prior Publication Data

US 2002/0153072 A1 Oct. 24, 2002

(30) Foreign Application Priority Data

Feb. 16, 2001 (JP) ..... 2001-039464

(51) Int. Cl.[7] ..... C22C 21/06
(52) U.S. Cl. ..... 148/417; 420/532; 420/543
(58) Field of Search ..... 148/417; 420/532, 420/543

(56) References Cited

U.S. PATENT DOCUMENTS 4,721,537 A * 1/1988 Ghosh ..... 148/698

OTHER PUBLICATIONS

Callister, William D. Jr. "Materials Science and Engineering: An Introduction", 3rd Ed., 1994, John Wiley & Sons, INC. pp 76–77.*

* cited by examiner

*Primary Examiner*—George Wyszomierski
*Assistant Examiner*—Janelle Combs Morillo
(74) *Attorney, Agent, or Firm*—Flynn, Thiel, Boutell & Tanis, P.C.

(57) ABSTRACT

The present invention provides an aluminum alloy structural plate excelling in strength and corrosion resistance, in particular, resistance to stress corrosion cracking, and a method of manufacturing the aluminum alloy plate. This aluminum alloy structural plate includes 4.8–7% Zn, 1–3% Mg, 1–2.5% Cu, and 0.05–0.25% Zr, with the remaining portion consisting of Al and impurities, wherein the aluminum alloy structural plate has a structure in which grain boundaries with a ratio of misorientations of 3–10° is 25% or more at the plate surface. The aluminum alloy structural plate is manufactured by: homogenizing an ingot of an aluminum alloy having the above composition; hot rolling the ingot; repeatedly rolling the hot-rolled product at 400–150° C. so that the degree of rolling is 70% or more to produce a plate with a specific thickness, or repeatedly rolling the hot-rolled product at a material temperature of 400–150° C. in a state in which rolls for hot rolling are heated at 40° C. or more so that the degree of rolling is 70% or more to produce a plate material with a specific thickness; subjecting the plate material to a solution heat treatment at 450–500° C. for five minutes or more; and cooling the resulting plate material at a cooling rate of 10° C. or more.

2 Claims, 1 Drawing Sheet

θ : Misorientation

θ : Misorientation

ALUMINUM ALLOY STRUCTURAL PLATE EXCELLING IN STRENGTH AND CORROSION RESISTANCE AND METHOD OF MANUFACTURING SAME

BACKGROUND OF THE INVENTION

1. Field of the Invention

The present invention relates to an aluminum alloy plate excelling in strength and corrosion resistance. More particularly, the present invention relates to an aluminum alloy plate excelling in strength and corrosion resistance which is suitably used for airplanes and vehicles, and to a method of manufacturing the aluminum alloy plate.

2. Description of Background Art

As an example of aluminum alloy structural plates, in particular, aluminum alloy plates for airplanes, a method of manufacturing a stringer material for airplanes has been proposed (Japanese Patents No. 1,337,646 to No. 1,337,649, No. 1,339,927, No. 1,405,136, and the like).

A specific example of the manufacturing method is as follows. An ingot of a JIS A7075 alloy is homogenized at about 450° C. for 10–20 hours. The ingot is hot-rolled at 400–450° C. to produce a plate material with a thickness of about 6 mm. The plate material is intermediate-annealed at about 410° C. for one hour, and cold-rolled at 100° C. or less to produce a cold-rolled plate with a thickness of 3–4 mm. The cold-rolled plate is subjected to a solution heat treatment by rapidly heating the plate to 320–500° C., and aged at about 120° C. for several to 24 hours to obtain a stringer material having a specific strength.

The aging step enables precipitation hardening to occur without causing the crystal grain size to change, whereby the resulting plate material has an average crystal grain size of 25 $\mu$m or less and exhibits sufficient strength and formability for practical applications. However, even if the corrosion resistance, in particular, resistance to stress corrosion cracking, is judged as good in laboratory corrosion resistance evaluation, resistance to stress corrosion cracking is not necessarily satisfactory under a practical use environment. Therefore, further improvement of corrosion resistance has been demanded.

It is preferable to decrease the crystal grain size from the viewpoint of mechanical strength and formability of metal materials. However, a decrease in the crystal grain size may cause corrosion resistance to deteriorate. The present inventors have conducted experiments and examinations of the relation between a decrease in the crystal grain and resistance to stress corrosion cracking of a 7000 series aluminum alloy containing Zn and Mg. As a result, the present inventors have found that resistance to stress corrosion cracking is affected by the difference in crystal orientation (misorientation) between adjacent crystal grains.

As shown in FIG. 1, misorientation between adjacent crystal grains shows a degree of angular difference (misorientation θ) between a crystal grain 1 and a crystal grain 2 with respect to the common rotation axis. As a result of examination of the crystal grains after the solution heat treatment in the manufacture of stringer materials for airplanes, it was found that high angle boundaries with misorientations of 20° or more were formed. In this case, grain boundary segregation of second phase compounds is increased during the succeeding aging. This causes the electrochemical characteristics to differ between the inside of the grain and the grain boundaries, thereby decreasing corrosion resistance.

SUMMARY OF THE INVENTION

The present invention has been achieved based on the above findings. The first object of the present invention is to solve conventional problems relating to an aluminum alloy structural plate and to provide an aluminum alloy structural plate excelling in strength and exhibiting improved corrosion resistance, in particular, resistance to stress corrosion cracking. Use of this aluminum alloy plate enables structures to be manufactured at reduced cost and improves reliability.

The second object of the present invention is to provide a method of manufacturing an aluminum alloy structural plate enabling the above aluminum alloy structural plate to be manufactured stably and securely.

The first object of the present invention is achieved by an aluminum alloy structural plate comprising 4.8–7% Zn, 1–3% Mg, 1–2.5% Cu, and 0.05–0.25% Zr, with the remaining portion consisting of Al and impurities, wherein the aluminum alloy structural plate has a structure containing 25% or more of crystal grain boundaries with misorientations of 3–10° at the surface of the aluminum alloy plate. In this aluminum alloy structural plate, an average crystal grain size may be 10 $\mu$m or less at the plate surface.

The second object of the present invention is achieved by a method of manufacturing an aluminum alloy structural plate comprising: homogenizing an ingot of an aluminum alloy having the above composition; hot rolling the ingot; repeatedly rolling the hot-rolled product at 400–150° C. so that the degree of working is 70% or more to produce a plate material with a specific thickness; subjecting the plate material to a solution heat treatment at 450–490° C. for five minutes or more; and cooling the resulting plate material at a cooling rate of 10° C./second or more. The second object of the present invention is also achieved by a method of manufacturing an aluminum alloy structural plate comprising: homogenizing an ingot of an aluminum alloy having the above composition; hot rolling the ingot; repeatedly rolling the hot-rolled product at 400–150° C. in a state in which a roll for hot rolling is heated at 40° C. or more so that the degree of working is 70% or more to produce a plate material with a specific thickness; subjecting the plate material to a solution heat treatment at 450–500° C. for five minutes or more; and cooling the resulting plate material at a cooling rate of 10° C./second or more.

DETAILED DESCRIPTION OF THE INVENTION AND PREFERRED EMBODIMENT

Figure 1:
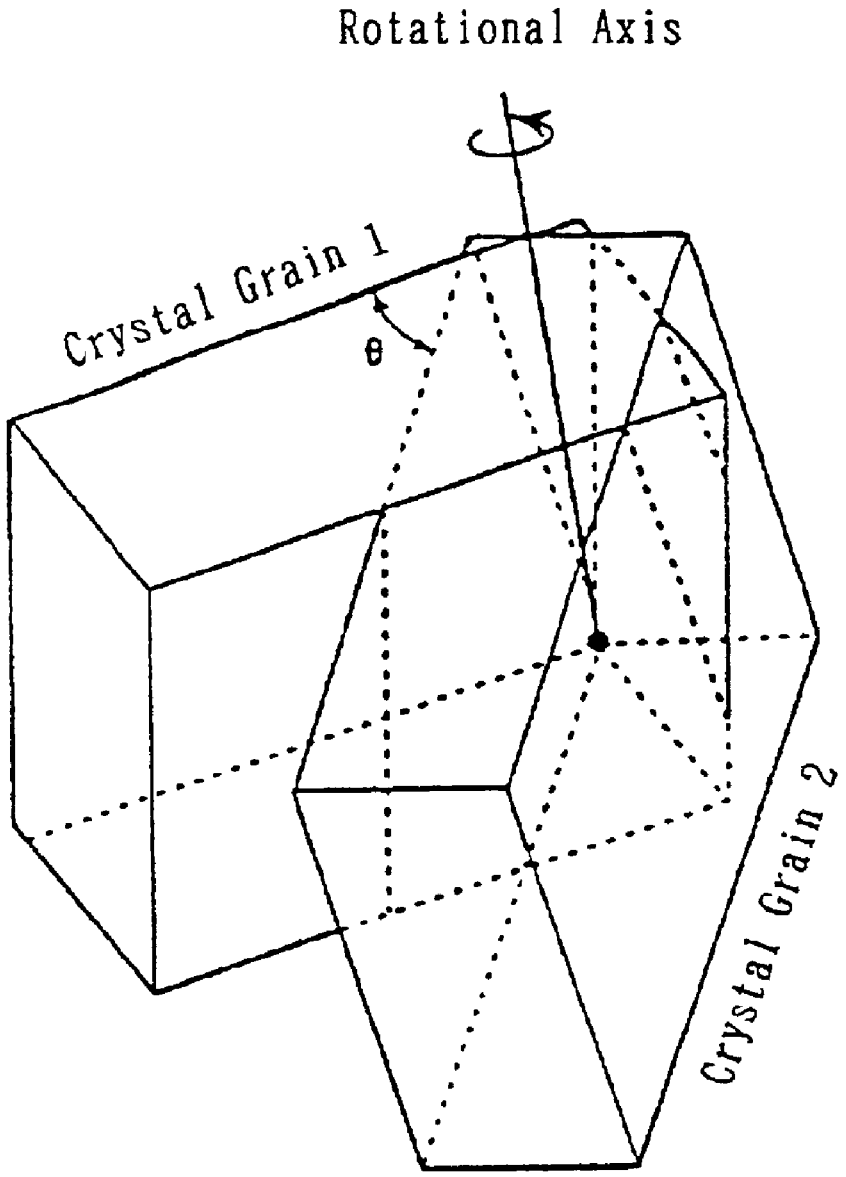
FIG. 1 is a view showing misorientation of crystal grains.

The feature of the present invention is to obtain high strength and high corrosion resistance by suitably combining the alloy composition of a 7000 series aluminum alloy and crystal misorientation. The meanings and the reasons for limitations of the components in the present invention are described below. Zn forms fine Zn-Mg precipitations during aging, thereby improving the strength of the materials due to precipitation hardening. The Zn content is preferably 4.8–7%. If the Zn content is less than 4.8%, strength as high as that of a conventional JIS A7075 alloy or JIS A7475 alloy may not be obtained. If the Zn content exceeds 7%, cracks or the like may occur due to inferior hot workability. In addition, Zn limits the growth of crystal grains during a solution heat treatment. The Zn content is still more preferably 5.0–6.5%.

Mg improves the strength in the same manner as Zn. The Mg content is preferably 1–3%. If the Mg content is less than 1%, it is difficult to obtain a strength as high as that of the conventional alloys. If the Mg content exceeds 3%, cracks or the like may occur due to inferior hot workability.

Cu produces fine precipitations of Al-Cu-Mg compounds during aging, thereby improving the strength of the material due to precipitation hardening. The Cu content is preferably 1–2.5%. If the Cu content is less than 1%, it is difficult to obtain strength as high as that of the conventional alloys. If the Cu content exceeds 2.5%, cracks or the like may occur due to inferior hot workability.

Zr limits the growth of crystal grains during the solution heat treatment, thereby allowing a large amount of low angle boundaries to remain. The Zr content is preferably 0.05–0.25%. If the Zr content is less than 0.05%, the effect may be insufficient. If the Zr content exceeds 0.25%, giant Al-Zr compounds are produced during casting, whereby formability of the resulting plate may decrease. The effect of limiting the growth of crystal grains during the solution heat treatment is saturated even if more than 0.25% of Zr is contained, whereby no further effect is obtained. The Zr content is still more preferably 0.08–0.20%.

In the present invention, Mn, Cr, Ti, B, Fe, and Si may be included in such an amount that these elements are generally included in a 7000 series aluminum alloy. The Fe content and the Si content are preferably 0.5% or less, respectively, from the viewpoint of formability. The Cr content is preferably 0.05% or less.

In combination with the above composition, it was found that segregation at the grain boundaries after aging was decreased when the misorientation was 10° or less. Since the structure having such low angle boundaries was micrograined, the degree of segregation at the grain boundaries was further decreased due to an increased grain boundary area, thereby improving corrosion resistance. As a result of examination on the distribution of misorientation in 0.02 $mm^2$ or more at the plate surface, resistance to stress corrosion cracking was significantly improved in the case where low angle grain boundaries of 3–10° made up 25% or more of all the grain boundaries.

In a structure in which low angle grain boundaries of 3–10° make up 25% or more of all the grain boundaries, the average crystal grain diameter is decreased. However, if the average crystal grain diameter exceeds 10 $\mu$m, stress corrosion cracking resistance and the strength of the material decrease. Therefore, the average crystal grain diameter is preferably limited to 10 $\mu$m or less.

Misorientation is measured using an automatic measurement system including a scanning electron microscope (SEM) in combination with a CCD camera. The automatic measurement system allows electron beams to be incident on the crystal surface that appears on the surface of a sample and captures a Kikuchi pattern using the CCD camera, and specifies the crystallite orientation using a computer. A rotational axis common to adjacent crystal grains can be determined by specifying each crystallite orientation, whereby the angular difference relative to the rotational axis (misorientation) can be determined. In the present invention, the lower limit for misorientation is set at 3° taking into consideration the resolution, error, and the like of the measurement system.

The first method of manufacturing the aluminum alloy structural plate of the present invention is described below.

An aluminum alloy having the above composition is cast using conventional DC casting, for example. The resulting ingot is homogenized and hot worked according to a conventional method. Intermediate annealing may be performed after hot working according to a conventional method. However, intermediate annealing may be omitted.

The feature of the present invention is that rolling is repeatedly performed at a temperature of 400–150° C., and preferably 350–180° C. until the degree of working becomes 70% or more. A substructure capable of limiting the growth of crystal grains during the succeeding solution heat treatment can be formed by repeated rolling within a specific temperature range. If the degree of working is less than 70%, fine precipitations of Zr may become insufficient, whereby it is difficult to limit the growth of crystal grains during the solution heat treatment. If the repeated rolling is started at a temperature exceeding 400° C., precipitation of Zr may be inhibited, thereby decreasing the effect of limiting the growth of crystal grains during the solution heat treatment. If the repeated rolling is started at a temperature of less than 150° C., precipitation of Zr is delayed, thereby decreasing the effect of limiting the growth of crystal grains during the solution heat treatment.

After the hot worked product is rolled to a specific thickness by repeated rolling, the wrought product is subjected to the solution heat treatment at a temperature of 450–490° C. for five minutes or more, and cooled at a cooling rate of 10° C./second or more. If the solution heat treatment temperature is less than 450° C., solid dissolution of alloy elements may become insufficient, whereby a specific strength cannot be obtained after aging. If the solution heat treatment temperature exceeds 490° C., the growth of crystal grains may not be limited, thereby decreasing the ratio of low angle boundaries of 10° or less.

If the cooling rate after the solution heat treatment is less than 10° C./second, second phase precipitation may occur during cooling, whereby a specific strength cannot be obtained after aging due to a decrease in the effect of the solution heat treatment. After the solution heat treatment and cooling, the resulting product is aged according to a conventional method.

In the present invention, it is important to add the transition element Zr as the alloy element in order to prevent the growth of crystal grains (increase in misorientation) during the solution heat treatment by causing Zr to finely precipitate during rolling at 400–150° C. Cr, which is also a transition element, may be added to the aluminum alloy for refinement of the structure. However, this is ineffective in the present invention. Combined use of Cr and Zr could not limit the growth of crystal grains during the solution heat treatment.

Studies conducted so far show that a structure having low angle grain boundaries (subgrain structure) is obtained by heating a heavily deformed aluminum alloy at a medium temperature of 100–300° C. However, a solution heat treatment at a temperature of 450° C. or more is indispensable for the 7000 series aluminum alloy of the present invention. A structure having a large number of low angle grain boundaries must be maintained after the solution heat treatment. As a result of a number of experiments and examinations relating to the manufacturing method to achieve this object, the present inventors have found that a technique of repeatedly rolling the alloy at a temperature of 400–150° C. until the degree of working becomes 70% or more is effective. This finding has led to the completion of the present invention.

The second method of manufacturing an aluminum alloy structural plate of the present invention is described below.

An aluminum alloy having the above composition is cast using conventional DC casting, for example. The resulting ingot is homogenized and hot worked according to a conventional method. Intermediate annealing may be performed after hot working according to a conventional method. However, intermediate annealing may be omitted.

The feature of the present invention is that rolling is repeatedly performed at a temperature of 400–150° C., and preferably 350–180° C. until the degree of working becomes 70% or more in a state in which rolls (a pair of work rolls) of a rolling mill used for hot rolling is heated to 40° C. or more. A substructure capable of limiting the growth of crystal grains during the succeeding solution heat treatment can be formed by these rolling conditions.

If the temperature of the work rolls is less than 40° C., the material is sheared strongly during rolling, thereby causing recrystallization to occur during reheating. As a result, formation of a thermally stable substructure is inhibited. The upper limit for the work roll temperature is preferably 400° C. or less taking into consideration the effects on a lubricant and an excessive increase in the material temperature.

If the degree of working is less than 70%, fine precipitations of Zr may become insufficient, whereby it is difficult to limit the growth of crystal grains during the solution heat treatment. If the repeated rolling is started at a material temperature exceeding 400° C., fine precipitations of Zr maybe inhibited. Moreover, a worked structure introduced during rolling tends to be easily recovered. Therefore, a thermally stable substructure may not be formed, whereby the effect of limiting the growth of crystal grains during the solution heat treatment becomes insufficient. If the material temperature is less than 150° C., precipitation of Zr may be delayed, thereby decreasing the effect of limiting the growth of crystal grains during the solution heat treatment.

After the hot worked product is rolled to a specific thickness by repeated rolling, the wrought product is subjected to the solution heat treatment at a temperature of 450–500° C., and preferably 460–490° C. for five minutes or more, and cooled at a cooling rate of 10° C./second or more. The solution heat treatment is a necessary step to obtain precipitation hardening during the succeeding aging. If the solution heat treatment temperature is less than 450° C., solid dissolution of alloy elements may become insufficient, whereby a specific strength cannot be obtained after aging. If the solution heat treatment temperature exceeds 500° C., the growth of crystal grains may not be limited, thereby decreasing the ratio of low angle boundaries of 10° or less.

If the cooling rate after the solution heat treatment is less than 10° C./second, second phase precipitation may occur during cooling, whereby a specific strength cannot be obtained after aging due to a decrease in the effect of the solution heat treatment. After the solution heat treatment and cooling, the resulting product is aged according to a conventional method.

Studies conducted so far show that a structure having low angle grain boundaries (subgrain structure) is obtained by heating a heavily deformed aluminum alloy at a medium temperature of 100–300° C. However, a solution heat treatment at a temperature of 450° C. or more is indispensable for the 7000 series aluminum alloy of the present invention. A structure having a large number of low angle grain boundaries must be maintained after the solution heat treatment. As a result of experiments and examinations relating to the manufacturing method to achieve this object, the present inventors have found that a technique of repeatedly rolling the alloy at a material temperature of 400–150° C. until the degree of working becomes 70% or more in a state in which the work rolls is heated to 40° C. or more is effective. This finding has led to the completion of the present invention.

EXAMPLES

The present invention is described below by comparing examples of the present invention with comparative examples. The effects of the present invention will be demonstrated based on this comparison. The examples illustrate only one preferred embodiment of the present invention, which should not be construed as limiting the present invention.

Example 1

Aluminum alloys having compositions shown in Table 1 were cast using a DC casting method. The resulting billets (diameter: 90 mm) were cut into pieces with a length of 100 mm. The billets were homogenized at 470° C. for 10 hours and forged at 400° C. to prepare specimens with a thickness of 30 mm.

The above specimens were machined to a thickness of 20 mm, and repeatedly rolled at a temperature of 350–200° C. to prepare plate materials with a thickness of 1.5 mm. Rolling was repeated 12 times. The plate materials were subjected to a solution heat treatment at 480° C. for five minutes in a salt bath and cooled with water. The plate materials were aged at 120° C. for 24 hours to obtain test materials.

The resulting test materials were subjected to observation of the crystal grain structure, a tensile test, and an estimation of resistance to stress corrosion cracking resistance test according to the following methods. Observation of crystal grain structure:

The crystal grain structure at the plate surface was observed using an SEM (manufactured by Hitachi, Ltd.) and an EBSD (Electron backscatter diffraction) system (manufactured by Oxford Instruments Analytical). The percentage of crystal grain boundaries exhibiting misorientations of 3–10° was determined from a histogram showing a difference in crystal orientation (misorientation) distribution Tensile Test:

Test specimens were collected in the direction 90° relative to the rolling direction of the test materials. A tensile test was performed using an Instron tensile machine with a benchmark distance between the test specimens of 10 mm. Tensile strength ($\sigma_B$), 0.2% yield strength ($\sigma_{0.2}$), and elongation ($\delta$) were measured.

Estimation of Resistance to Stress Corrosion Cracking:

Test specimens were collected in the direction 90° relative to the rolling direction of the test materials. An 82% load of 0.2% yield strength was applied to the test specimens. An alternating immersion test in which a cycle consisting of immersing the test specimens in a 3.5% NaCl solution at 30° C. for 10 minutes and drying the test specimens at 25° C. for 50 minutes was repeatedly performed. The number of breaks within the test period of 200 hours was measured. The stress corrosion cracking resistance test was performed by preparing five pieces of test specimens from each alloy.

The results of these observation and tests are shown in Table 2. As is clear from Table 2, test materials Nos. 1–4 according to the present invention had excellent yield strength of more than 500 MPa and exhibited excellent stress corrosion cracking resistance, in which no breaks occurred in the stress corrosion cracking resistance test.

TABLE 1

| Alloy | Composition (mass %) Zn | Mg | Cu | Zr | Cr |
|---|---|---|---|---|---|
| A | 5.00 | 2.50 | 1.50 | 0.18 | <0.01 |
| B | 6.50 | 1.20 | 1.20 | 0.10 | <0.01 |
| C | 5.80 | 1.40 | 2.20 | 0.22 | <0.01 |
| D | 4.80 | 1.10 | 1.50 | 0.10 | <0.01 |

TABLE 2

| Test material | Alloy | Ratio of low angle (%) | Average grain diameter (μm) | Mechanical properties $\sigma_{0.2}$ MPa | $\sigma_B$ MPa | δ % | Stress corrosion cracking Number of breaks/5 |
|---|---|---|---|---|---|---|---|
| 1 | A | 35 | 5.5 | 525 | 585 | 19 | 0/5 |
| 2 | B | 29 | 6.2 | 530 | 595 | 20 | 0/5 |
| 3 | C | 50 | 2.8 | 543 | 611 | 17 | 0/5 |
| 4 | D | 26 | 6.5 | 515 | 572 | 19 | 0/5 |

Comparative Example 1

Aluminum alloys having compositions shown in Table 3 were cast using a DC casting method. The resulting billets (diameter: 90 mm) were cut into pieces with a length of 100 mm. The billets were homogenized at 470° C. for 10 hours and forged at 400° C. to prepare specimens with a thickness of 30 mm. Test materials were prepared by processing the specimens in the same manner as in Example 1. The resulting test materials were subjected to observation of the crystal grain structure, a tensile test, and an estimation of resistance to stress corrosion cracking according to the same methods as in Example 1. The Results are Shown in Table 4.

TABLE 3

| Alloy | Composition (mass %) Zn | Mg | Cu | Zr | Cr |
|---|---|---|---|---|---|
| E | 4.20 | 1.50 | 1.50 | 0.20 | <0.01 |
| F | 5.30 | 0.70 | 0.60 | 0.20 | <0.01 |
| G | 6.50 | 1.10 | 1.20 | 0.04 | <0.01 |
| H | 7.30 | 1.50 | 1.30 | 0.10 | <0.01 |
| I | 5.50 | 2.20 | 1.50 | <0.01 | 0.22 |

Alloy 1: JIS A7475

TABLE 4

| Test material | Alloy | Ratio of low angle (%) | Average grain diameter μm | Mechanical properties $\sigma_{0.2}$ MPa | $\sigma_B$ MPa | δ % | Stress corrosion cracking Number of breaks/5 |
|---|---|---|---|---|---|---|---|
| 5 | E | 19 | 6.8 | 470 | 550 | 20 | 1/5 |
| 6 | F | 30 | 7.5 | 465 | 545 | 20 | 0/5 |
| 7 | G | 15 | 22 | 495 | 566 | 21 | 5/5 |
| 8 | H | — | — | — | — | — | — |
| 9 | I | 6 | 15 | 490 | 560 | 22 | 5/5 |

As shown in Table 4, test material No. 5 showed insufficient strength due to low Zn content, and exhibited inferior resistance to stress corrosion cracking resistance due to a low percentage of low angle boundaries. Test material No. 6 showed insufficient strength due to low Mg content and Cu content. Test material No. 7 exhibited insufficient effects of limiting the growth of crystal grains during the solution heat treatment due to low Zr content, and exhibited inferior resistance to stress corrosion cracking resistance due to a low percentage of low angle boundaries. Cracks occurred in test material No. 8 containing Zn in an amount exceeding the upper limit, whereby a final plate could not be produced. Test material No. 9 was a conventional JIS A7475 alloy and exhibited inferior resistance to stress corrosion cracking resistance due to a low percentage of low angle boundaries.

Example 2

Characteristics of the alloy A in Example 1 were evaluated by changing the manufacturing conditions. Conditions for casting, homogenization, hot forging, and machining were the same as those in Example 1. Steps after repeated rolling were performed under the conditions shown in Table 5 to prepare test materials. Rolling was performed 8–12 times. Aging was performed at 120° C. for 24 hours.

The resulting test materials were subjected to observation of the crystal grain structure, a tensile test, and an estimation of resistance to stress corrosion cracking according to the same methods as in Example 1. The results are shown in Table 6. As is clear from Table 6, test materials Nos. 10–14 according to the present invention had excellent yield strength of more than 500 MPa and exhibited excellent resistance to stress corrosion cracking, in which no breaks occurred in the stress corrosion cracking test.

TABLE 5

| Condition | Repeated rolling Temperature range (° C.) | Degree of working (%) | Solution heat treatment (° C.-min.) | Cooling rate (° C./sec.) |
|---|---|---|---|---|
| a | 320-180 | 80 | 480-5 | 100 |
| b | 350–220 | 95 | 485-5 | 100 |
| c | 350–200 | 75 | 480-5 | 100 |
| d | 350–200 | 95 | 485-5 | 50 |
| e | 385–220 | 95 | 480-5 | 100 |

TABLE 6

| Test material | Alloy | Ratio of low angle (%) | Average grain diameter (μm) | Mechanical properties $\sigma_{0.2}$ MPa | $\sigma_B$ MPa | δ % | Stress corrosion cracking Number of breaks/5 |
|---|---|---|---|---|---|---|---|
| 10 | a | 28 | 7.1 | 520 | 577 | 20 | 0/5 |
| 11 | b | 35 | 5.4 | 526 | 588 | 19 | 0/5 |
| 12 | c | 28 | 7.4 | 520 | 575 | 20 | 0/5 |
| 13 | d | 36 | 5.2 | 520 | 580 | 19 | 0/5 |
| 14 | e | 26 | 8.5 | 507 | 570 | 20 | 0/5 |

Comparative Example 2

Characteristics of the alloy A in Example 1 were evaluated by changing the manufacturing conditions. Conditions for casting, homogenization, hot forging, and machining were the same as those in Example 1. Steps after repeated rolling were performed under the conditions shown in Table 7 to prepare test materials. Rolling was repeated 8–12 times. Aging was performed at 120° C. for 24 hours. The resulting test materials were subjected to observation of the crystal grain structure, a tensile test, and an estimation of resistance to stress corrosion cracking according to the same methods as in Example 1. The results are shown in Table 8.

TABLE 7

| Condition | Repeated rolling: Temperature range (° C.) | Repeated rolling: Degree of working (%) | Solution heat treatment (° C.-min.) | Cooling rate (° C./sec.) |
|---|---|---|---|---|
| f | 420–220 | 80 | 480-5 | 100 |
| g | 320–140 | 80 | 480-5 | 100 |
| h | 350–200 | 55 | 480-5 | 100 |
| i | 350–200 | 95 | 500-5 | 100 |
| j | 350–200 | 75 | 480-5 | 1 |

TABLE 8

| Test material | Alloy | Ratio of low angle (%) | Average grain diameter (μm) | Mechanical properties: $\sigma_{0.2}$ MPa | Mechanical properties: $\sigma_B$ MPa | Mechanical properties: δ % | Stress corrosion cracking: Number of breaks/5 |
|---|---|---|---|---|---|---|---|
| 15 | f | 19 | 14 | 500 | 565 | 22 | 2/5 |
| 16 | g | 20 | 10.5 | 505 | 568 | 21 | 2/5 |
| 17 | h | 6 | 15 | 495 | 562 | 22 | 1/5 |
| 18 | i | 8 | 25 | 520 | 575 | 20 | 3/5 |
| 19 | j | 30 | 5.5 | 485 | 560 | 22 | 1/5 |

As shown in Table 8, test material No. 15 could not limit the growth of crystal grains during the solution heat treatment since the effects of Zr were insufficient due to a high rolling start temperature, thereby exhibiting inferior resistance to stress corrosion cracking. Test material No. 16 could not limit the growth of crystal grains during the solution heat treatment since the effects of Zr were insufficient due to a low temperature during repeated rolling, thereby exhibiting inferior resistance to stress corrosion cracking. Test material No. 17 could not limit the growth of crystal grains during the solution heat treatment since precipitation of Zr was sufficient due to a low degree of working, thereby exhibiting inferior resistance to stress corrosion cracking. Crystal grains were grown in test material No. 18 due to a high solution heat treatment temperature, thereby exhibiting inferior resistance to stress corrosion cracking. Second phase precipitation occurred in test material No. 19 due to a low cooling rate after the solution heat treatment, whereby sufficient precipitation hardening was not obtained during aging. Moreover, breaks occurred in the test on stress corrosion cracking.

Example 3

Aluminum alloys having compositions shown in Table 9 were cast using a DC casting method. The resulting billets (diameter: 90 mm) were cut into pieces with a length of 100 mm. The billets were homogenized at 470° C. for 10 hours and forged at 400° C. to prepare specimens with a thickness of 30 mm.

The resulting specimens were machined to a thickness of 20 mm and rolled under the conditions shown in Table 10 to prepare plate materials. The plate materials were cold rolled to a thickness of 1 mm. The plate materials were subjected to a solution heat treatment in a salt bath and cooled under the conditions shown in Table 10. The plate materials were aged at 120° C. for 24 hours to obtain test materials. Rolling was repeated 8–12 times by employing a method in which the materials were reheated when the material temperature decreased.

The resulting test materials were subjected to observation of the crystal grain structure, a tensile test, and an estimation of resistance to stress corrosion cracking according to the same methods as in Example 1. The results are shown Table 11.

As is clear from Table 11, test materials Nos. 20–24 according to the present invention had excellent yield strength of more than 500 MPa and exhibited excellent resistance to stress corrosion cracking, in which no breaks occurred in the test on stress corrosion cracking.

TABLE 9

| Alloy | Composition (mass %): Zn | Mg | Cu | Zr | Cr |
|---|---|---|---|---|---|
| J | 5.5 | 2.3 | 1.4 | 0.16 | <0.01 |

TABLE 10

| Test material | Alloy | Rolling condition: Roll temp. (° C.) | Rolling condition: Material temp. (° C.) | Rolling condition: Degree of working (%) | Solution heat treatment Temp. (° C.) – Time (min.) | Cooling rate (° C./sec.) |
|---|---|---|---|---|---|---|
| 20 | J | 50 | 350–200 | 95 | 480 – 5 | 100 |
| 21 | J | 100 | 300–180 | 75 | 480 – 5 | 100 |
| 22 | J | 70 | 370–220 | 90 | 460 – 20 | 100 |
| 23 | J | 100 | 350–200 | 95 | 480 – 10 | 50 |
| 24 | J | 80 | 360–200 | 85 | 480– 5 | 100 |

TABLE 11

| Test material | Alloy | Ratio of low angle (%) | Average grain diameter (μm) | Mechanical properties: $\sigma_{0.2}$ Mpa | Mechanical properties: $\sigma_B$ MPa | Mechanical properties: δ % | Stress corrosion cracking: Number of breaks/5 |
|---|---|---|---|---|---|---|---|
| 20 | J | 45 | 2.8 | 540 | 605 | 18 | 0/5 |
| 21 | J | 33 | 7.0 | 515 | 590 | 20 | 0/5 |
| 22 | J | 40 | 5.2 | 510 | 585 | 20 | 0/5 |
| 23 | J | 45 | 3.0 | 540 | 612 | 20 | 0/5 |
| 24 | J | 38 | 5.0 | 517 | 603 | 19 | 0/5 |

Comparative Example 3

The billet (diameter: 90 mm) of the alloy J cast in Example 1 was cut into pieces with a length of 100 mm. The pieces were homogenized at 470° C. for 10 hours and forged at 400° C. to prepare specimens with a thickness of 30 mm.

The resulting specimens were machined to a thickness of 20 mm and rolled under the conditions shown in Table 12 to prepare plate materials. The plate materials were cold rolled to a thickness of 1 mm. The plate materials were subjected to a solution heat treatment in a salt bath and cooled under the conditions shown in Table 12. The plate materials were aged at 120° C. for 24 hours to obtain test materials. Rolling was repeated 8–12 times by employing a method in which the materials were reheated when the material temperature decreased.

A 7475 alloy (alloy S) having a composition shown in Table 13 was cast. The resulting billet (diameter: 90 mm) was cut into pieces with a length of 100 mm, homogenized at 470° C. for 10 hours, and forged at 400° C. to prepare a specimen with a thickness of 30 mm. The specimen was machined to a thickness of 20 mm and hot rolled at 450° C. to prepare a plate material with a thickness of 5 mm. The plate material was cold rolled to a thickness of 1 mm. The plate material was subjected to a solution heat treatment at 480° C. for five minutes in a salt bath and cooled at a cooling rate of 100° C./second. The plate material was aged at 120° C. for 24 hours to obtain a test material.

The resulting test materials were subjected to observation of the crystal grain structure, a tensile test, and an estimation of resistance to stress corrosion cracking according to the same methods as in Example 1. The results are shown Table 14.

TABLE 12

| Test material | Alloy | Rolling condition: Roll temp. (° C.) | Rolling condition: Material temp. (° C.) | Rolling condition: Degree of working (%) | Solution heat treatment Temp. (° C.) – Time (min.) | Cooling rate (° C./sec.) |
|---|---|---|---|---|---|---|
| 25 | J | 15 | 350–180 | 95 | 480 – 5 | 100 |
| 26 | J | 5 | 370–200 | 95 | 480 – 5 | 100 |
| 27 | J | 50 | 280–100 | 95 | 480 – 5 | 100 |
| 28 | J | 50 | 350–190 | 50 | 480 – 5 | 100 |
| 29 | J | 100 | 350–200 | 95 | 480 – 30 | 1 |
| 30 | J | 40 | 430–230 | 85 | 480 – 5 | 100 |

TABLE 13

| Alloy | Composition (mass %): Zn | Mg | Cu | Zr | Cr |
|---|---|---|---|---|---|
| S | 5.5 | 2.2 | 1.5 | <0.01 | 0.21 |

TABLE 14

| Test material | Alloy | Ratio of low angle (%) | Average grain diameter (μm) | Mechanical properties: $\sigma_{0.2}$ MPa | Mechanical properties: $\sigma_B$ MPa | Mechanical properties: δ % | Stress corrosion cracking: Number of breaks/5 |
|---|---|---|---|---|---|---|---|
| 25 | J | 6 | 15.2 | 492 | 564 | 21 | 4/5 |
| 26 | J | 5 | 32.0 | 487 | 560 | 20 | 5/5 |

TABLE 14-continued

| Test material | Alloy | Ratio of low angle (%) | Average grain diameter (μm) | Mechanical properties: $\sigma_{0.2}$ MPa | Mechanical properties: $\sigma_B$ MPa | Mechanical properties: δ % | Stress corrosion cracking: Number of breaks/5 |
|---|---|---|---|---|---|---|---|
| 27 | J | 10 | 25.2 | 490 | 560 | 22 | 4/5 |
| 28 | J | 12 | 8.8 | 502 | 573 | 20 | 1/5 |
| 29 | J | 43 | 3.5 | 455 | 535 | 21 | 1/5 |
| 30 | J | 8 | 20.4 | 490 | 565 | 20 | 2/5 |
| 31 | S | 6 | 15.5 | 495 | 576 | 22 | 3/5 |

Coarse grains were produced partially in test materials No. 25 and No. 26 after the solution heat treatment due to a low roll temperature. This caused an increase in the average crystal grain diameter and a decrease in a low angle ratio, whereby these test materials exhibited inferior resistance to stress corrosion cracking, as shown in Table 14. Test material No. 27 could not limit the growth of crystal grains during the solution heat treatment since the effects of Zr were insufficient due to a low material temperature during repeated rolling, thereby exhibiting inferior resistance to stress corrosion cracking. Test material No. 28 could not limit the growth of crystal grains during the solution heat treatment since precipitation of Zr was insufficient due to a low degree of working. This caused the low angle ratio to decrease, thereby exhibiting inferior resistance to stress corrosion cracking. Test material No. 29 exhibited insufficient strength due to a low cooling rate after the solution heat treatment, whereby breaks occurred during the test on stress corrosion cracking. A worked structure introduced by rolling was easily recovered in test material No. 30 due to a high rolling starting temperature. This inhibited formation of a thermally stable substructure, whereby a fine structure was not obtained after the solution heat treatment. As a result, this test material exhibited inferior resistance to stress corrosion cracking due to a low angle ratio. Test material No. 31 was a 7475 alloy (alloy S) plate obtained using conventional steps, in which breaks occurred during the test on stress corrosion cracking due to a low angle ratio.

Example 4 and Comparative Example 4

Aluminum alloys having compositions shown in Table 15 were cast using a DC casting method. The resulting billets (diameter: 90 mm) were cut into pieces with a length of 100 mm. The billets were homogenized at 470° C. for 10 hours and forged at 400° C. to prepare specimens with a thickness of 30 mm. The specimens were subjected to repeated rolling, solution heat treatment, and cooling under the same conditions as those for test material No. 20 in Example 1. The specimens were aged to obtain test materials. Rolling was repeated 12 times. The resulting test materials were subjected to observation of the crystal grain structure, a tensile test, and an estimation of resistance to stress corrosion cracking according to the same methods as in Example 1. The results are shown in Table 16.

TABLE 15

| | Composition (mass %) | | | | |
|---|---|---|---|---|---|
| Alloy | Zn | Mg | Cu | Zr | Cr |
| K | 5.8 | 2.2 | 1.5 | 0.20 | <0.01 |
| L | 4.9 | 2.8 | 2.0 | 0.18 | <0.01 |
| M | 6.1 | 1.7 | 1.5 | 0.12 | <0.01 |
| N | 5.6 | 1.2 | 1.8 | 0.22 | <0.01 |
| O | 3.9 | 1.5 | 1.5 | 0.15 | <0.01 |
| P | 5.3 | 0.43 | 0.51 | 0.12 | <0.01 |
| Q | 5.3 | 1.5 | 1.2 | 0.03 | <0.01 |
| R | 7.4 | 2.5 | 1.4 | 0.15 | <0.01 |

TABLE 16

| | | Ratio of low | Average grain | Mechanical properties | | | Stress corrosion cracking |
|---|---|---|---|---|---|---|---|
| Test material | Alloy | angle (%) | diameter ($\mu$m) | $\sigma_{0.2}$ MPa | $\sigma_B$ MPa | $\delta$ % | Number of breaks/5 |
| 32 | K | 42 | 3.0 | 540 | 604 | 19 | 0/5 |
| 33 | L | 38 | 3.5 | 526 | 590 | 19 | 0/5 |
| 34 | M | 40 | 2.8 | 554 | 612 | 17 | 0/5 |
| 35 | N | 36 | 3.8 | 532 | 598 | 20 | 0/5 |
| 36 | O | 12 | 12.0 | 445 | 523 | 21 | 1/5 |
| 37 | P | 16 | 16.0 | 448 | 520 | 20 | 1/5 |
| 38 | Q | 8 | 27.6 | 492 | 570 | 20 | 4/5 |
| 39 | R | — | — | — | — | — | — |

As shown in Table 16, test materials Nos. 32–35 according to the present invention showed a yield strength of more than 500 MPa, in which no breaks occurred in the stress corrosion cracking resistance test. On the contrary, test material No. 36 exhibited insufficient strength since a crystal microstructure was not obtained due to low Zn content. This test material exhibited inferior resistance to stress corrosion cracking due to a low percentage of low angle boundaries. Test material No. 37 showed insufficient strength due to low Mg content and Cu content, and exhibited insufficient effects of limiting the growth of crystal grains. Breaks occurred in this test material during the test on stress corrosion cracking due to a low percentage of low angle boundaries. Test material No. 38 exhibited insufficient effects of limiting the growth of crystal grains during the solution heat treatment due to low Zr content, and exhibited inferior resistance to stress corrosion cracking due to a low percentage of low angle boundaries. Cracks occurred in test material No. 39 containing Zn in an amount exceeding the upper limit during casting, whereby a test material could not be obtained.

According to the present invention, an aluminum alloy structural plate excelling in strength and corrosion resistance, in particular, resistance to stress corrosion cracking can be provided. Use of this aluminum alloy plate enables the thickness of the material to be decreased, whereby the weight of the structure and cost can be decreased. Moreover, reliability of the structure can be improved due to excellent resistance to stress corrosion cracking.

The present invention also provides a method of manufacturing an aluminum alloy plate capable of stably producing the above aluminum alloy structural plate, in particular, an aluminum alloy plate having a structure in which the average crystal grain size is 10 $\mu$m or less at the plate surface, and low angle boundaries with misorientations of 3–10° make up 25% or more of all the grain boundaries at the plate surface.

Obviously, numerous modifications and variations of the present invention are possible in light of the above teachings. It is therefore to be understood that, within the scope of the appended claims, the invention may be practiced other than as specifically described herein.

What is claimed is:

1. An aluminum alloy structural plate excelling in strength and corrosion resistance, comprising, in mass %, 4.8–7% Zn, 1–3% Mg, 1–2.5% Cu, and 0.05–0.25% Zr, with the remaining portion consisting of Al and impurities, wherein the aluminum alloy structural plate has a thickness of from 1–1.5 mm and has a structure containing 25% or more of grain boundaries with misorientations of 3–10° at the plate surface.

2. The aluminum alloy structural plate of claim 1, wherein the average grain size is 10 $\mu$m or less at the plate surface.

* * * * *